United States Patent [19]

Howell et al.

[11] Patent Number: 4,970,634

[45] Date of Patent: Nov. 13, 1990

[54] RADAR TRANSPARENT MATERIALS

[75] Inventors: William G. Howell, Northants; Frederick S. Ward, Northampton; John F. Graver, Banbury, all of England

[73] Assignee: Plessey Overseas Limited, Ilford, England

[21] Appl. No.: 357,069

[22] Filed: May 25, 1989

[30] Foreign Application Priority Data

May 25, 1988 [GB] United Kingdom ..... 8812410

[51] Int. Cl.[5] ..... F21V 7/22

[52] U.S. Cl. ..... 362/342; 362/348; 342/1; 343/909

[58] Field of Search ..... 362/296, 341, 342, 348; 342/1, 5; 343/909

[56] References Cited

U.S. PATENT DOCUMENTS

| | | | |
|---|---|---|---|
| 3,165,749 | 1/1965 | Crushner . | |
| 3,231,892 | 1/1966 | Matson et al. | 343/837 |
| 3,427,625 | 2/1969 | Kazimi . | |
| 3,878,506 | 4/1975 | Young . | |
| 3,975,738 | 8/1976 | Pelton et al. | 343/909 |
| 3,978,486 | 8/1976 | Reinders | 343/909 |
| 4,126,866 | 11/1978 | Pelton | 343/909 |
| 4,287,520 | 9/1981 | Van Vliet et al. | 343/909 |

OTHER PUBLICATIONS

Conference Proceedings Military Microwaves '86, Brighton, Jun. 24, 26, 1986, pp. 225-260, B. A. Munk et al.: "Composite Materials: Reactively Loaded Radomes".

IEEE Transactions on Antenna and Propagation, Nov. 1974, pp. 799-803 "A Streamline Metallic Radom" E. G. Pelton, B. A. Munk.

Thorn EMI Lighting Ltd., Publication No. 24695.3, no date.

*Primary Examiner*—Ira S. Lazarus

*Assistant Examiner*—Richard R. Cole

*Attorney, Agent, or Firm*—Fleit, Jacobson, Cohn, Price, Holman & Stern

[57] ABSTRACT

A structure for reflecting visible light or near visible light, wherein the structure is formed of a low dielectric constant material having an external surface comprising an electrically conductive layer of material which has an array of slots therein so as to be substantially transparent to microwave radiation of a predetermined wavelength which will impinge upon the structure during use, while being reflective to light.

22 Claims, 8 Drawing Sheets

DISCS

HEXAGONS

TRIANGLE

BARS

TRIPLE BARS

RADAR TRANSPARENT MATERIALS

This invention relates to materials and structures which are transparent to electromagnetic radiation, particularly though not exclusively radar transmissions in the GHz range.

Systems are proposed, intended for guiding aircraft in landing procedures operating on 5GHz using the time reference scanning beam principle which are intended for installation on civilian airports world wide by 1998. The beam scanning in azimuth is 2° wide and scans through 40° on either side of the runway centre line. The elevation beam is one degree wide and scans from zero to fifteen degrees elevation. Information from the ground-air data link is used to guide the aircraft onto the approach flight path as well as controlling its final descent. This system allows for curved, angular and steep approaches, and the greater flexibility which this gives to Air Traffic Control will help to reduce congestion at airports in the next decade.

The transmitting antennae are located at the ends of the runway. It has been discovered that some of the nearest approach lights may perturb the radiation pattern and introduce errors into the azimuth and elevation data supplied to the aircraft.

The basis of the present invention is in the realisation that such approach light structures can be made transparent to the microwave frequency range of interest, whilst still reflecting visible light.

Thus the present invention provides an airfield approach landing light or supporting structure therefor being formed of low dielectric constant plastics material and having an external light reflector surface comprising a layer of electrically conductive material which has an array of slots therein such as to be substantially transparent to microwave radiation of a predetermined frequency whilst being reflective to light.

As preferred the layer of slotted material is of metal which will reflect light. Thus when used as a reflector of a landing light, the metal layer may be polished or coated with reflective paint and provide an adequate reflector of light, yet still be transparent to a specific radar frequency. As an alternative to metal, a conductive material such as carbon reinforced plastics may be employed covered with a light reflecting layer such as glass spheres in resin.

Slotted metal layers have previously been described in IEEE Transactions on antenna and propagation, Nov. 1974 p.799–803 "A streamlined metallic radome" E. G. Pelton, B. A. Munk in connection with radomes, but their use has not been previously proposed in accordance with the present invention.

As preferred a regular array of slotted areas is provided, with each slotted area having an identical slot configuration. The slot configuration is dimensioned to be transparent to microwave radiation of a predetermined wavelength, and is preferably tripolar in form so as to pass radiation of any type and degree of polarisation. In a preferred form, the slot configuration is labyrinthine with two slot lengths extending parallel to one another in each of three equally spaced directions. The distance between nearest neighbours of the slot configurations is chosen to determine the wavelength of radiation that will be passed by the layer.

In an alternative design, an array of metal discs and wires can be configured to be transparent to the radar frequency of interest but can reflect sufficient light radiation to be used as a light reflector in landing light structure.

Although principally intended for aircraft landing lights, the present invention can be applied to any situation where a structure is required to reflect visible light or radiation having a wavelength close to that of visible light, for example ultra-violet and near infrared, in the situation where the reflecting structure may obstruct microwave radiation. Thus for example one may envisage a ship borne system where a light signalling system obstructs a radar system, and an air borne system on an aircraft wherein a transmitting light obstructs a radar transmitting system.

Thus in more general terms the present invention provides a structure for reflecting visible light or near visible light, wherein the structure is formed of a low dielectric constant material having an external surface comprising an electrically conductive layer of material which has an array of slots therein so as to be substantially transparent to microwave radiation of a predetermined wavelength which will impinge upon the structure during use, whilst being reflective to light.

A preferred embodiment of the invention will now be described with reference to the accompanying drawings wherein:

FIGS. 1*a* and 1*b* are respectively front and side cross-sectional views of a landing light in accordance with the invention, showing the bulb and bulb holder;

Figure 8A:
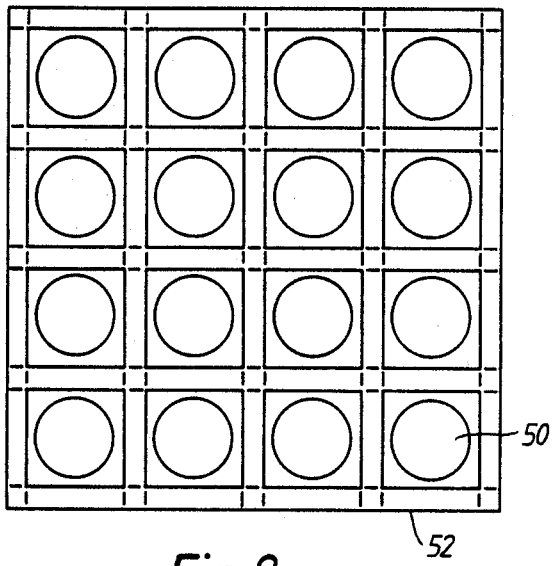
Figure 8B:
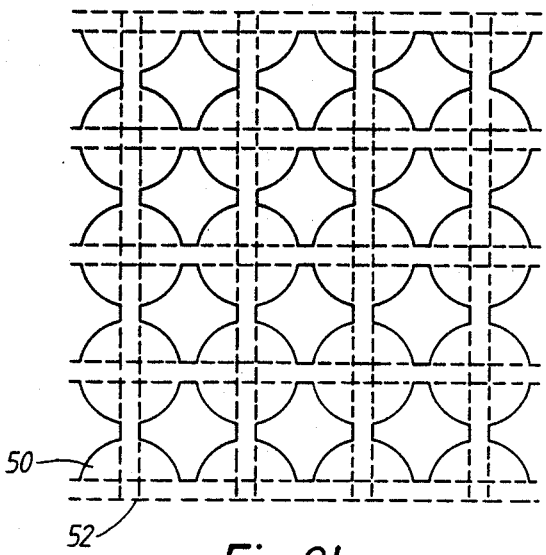
Figure 9:
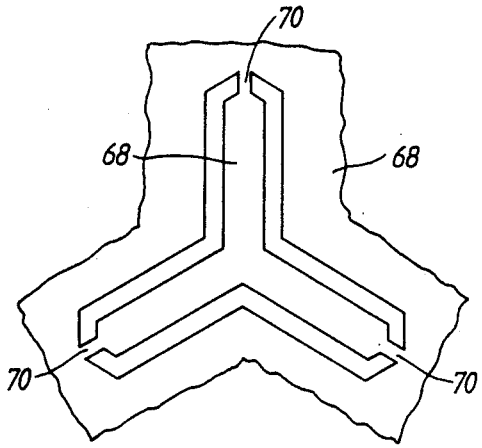
Figure 10:
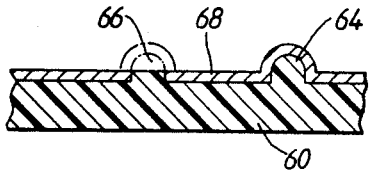

FIGS. 7*a* to 7*f* are views of alternative forms of the reflector material in accordance with the invention;

FIGS. 8*a* and 8*b* are views of different forms of the reflector material in accordance with the invention comprising wires and discs;

FIG. 9 is a close-up view of a tripolar slot arrangement of the reflector material and in accordance with the invention showing how the central piece is retained within the slots; and, FIG. 10 is a cross-sectional view of the material of FIG. 9, indicating the method of formation.

Figure 1A:
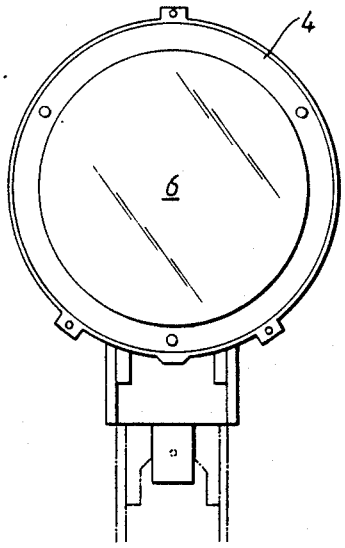
Figure 1B:
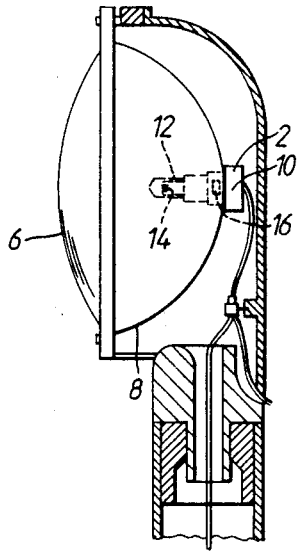

Referring to FIGS. 1*a* and 1*b*, there is shown a airfield landing light in accordance with the invention comprising a housing 2 formed of a non-conductive dielectric plastics material having a circular front aperture 4 in which a domed transparent plastics lens 6 is mounted. A parabolic reflector 8 is disposed within the casing and a bulb holder 10 is mounted at the centre of reflector 8 for receiving a tungsten halogen lamp 12. Bulb assembly 10 is formed of a ceramic material so as to be transparent as far as possible to microwave radiation. In addition the plane of the filament 14 of bulb 12 is positioned so to be perpendicular to the likely direction of the electric field of the microwave radiation. In addition the electric contact supports 16 for making electric contact with the lamp are positioned so as to be perpendicular to the likely direction of electric field of the microwave radiation.

Figure 2:
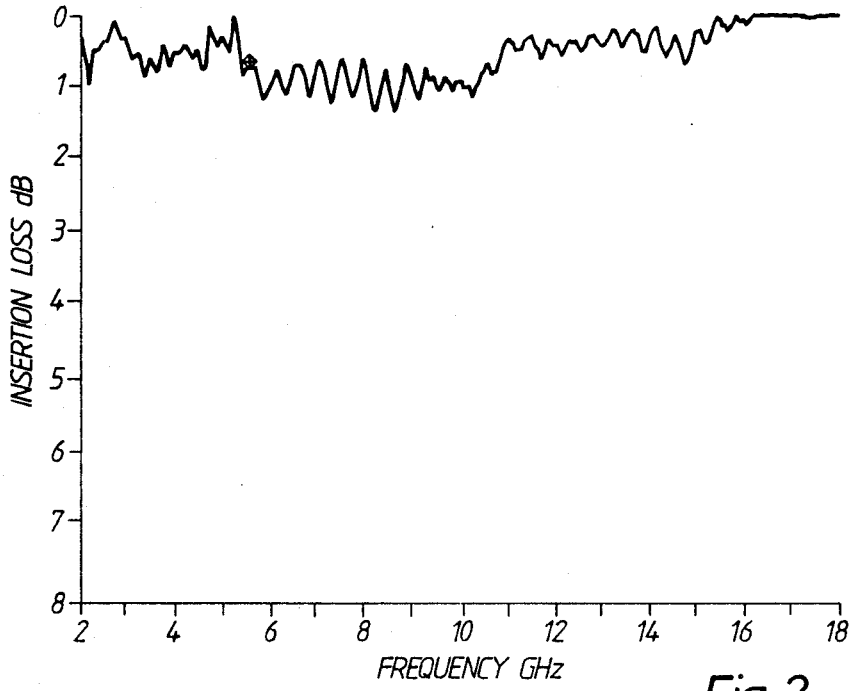
FIG. 2 is a graph showing the insertion loss of a plastics lens of the lamp.

Lens 6 is formed of an acrylic plastics material which has a low insertion loss (0.72 decibles) for microwave radiation (see FIG. 2). The lens may be regarded as a radome and its thickness is about a tenth of the wavelength of the radiation, i.e. about 6 mm. As an alternative to acrylic resin, a polycarbonate plastics may be used.

Figure 3:
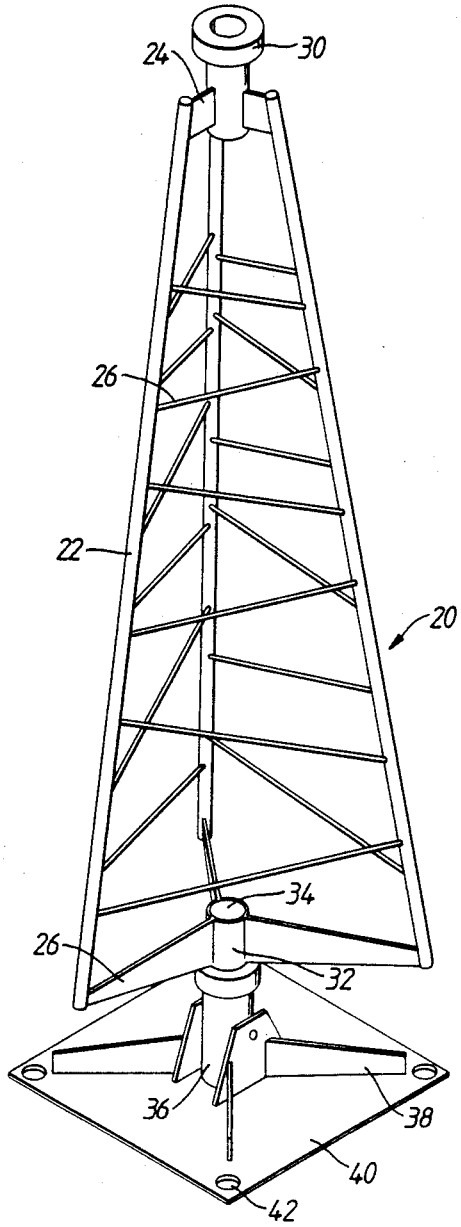
FIG. 3 is a perspective view of a mast structure for mounting the lamp of FIG. 1.

Before describing the construction of reflector 8, reference is made to FIG. 3 showing the supporting mast for the lamp. The mast comprises a tripod structure 20 of polypropylene material having a low permittivity and including three rods 22 inclined to the vertical in tripolar positions relative to one another and being supported at their top by a tripolar ridge arrangement 24 and at their bottom a tripolar ridge arrangement 26. The rods 22 are braced throughout their length by smaller diameter tie rods 26 which are disposed in a sequential manner firstly inclined downwardly to the horizontal and then inclined upwardly to the horizontal. Upper ridge arrangement 24 includes a plinth portion 30 for supporting the landing light whereas bottom ridge structure 26 includes a circular bearing member 32 for receiving a stub axle 34 of a upwardly projecting axle member 36, which is mounted by opposing ribs 38 on a flat rectangular member 40 which has holes 42 in its corners for bolting to the ground.

By appropriate rotation of the tripod structure about axle 34, the optimum angle may be found for minimum disturbance of microwave radiation passing through the structure in the desired direction for the microwave guidance system.

Figure 4:
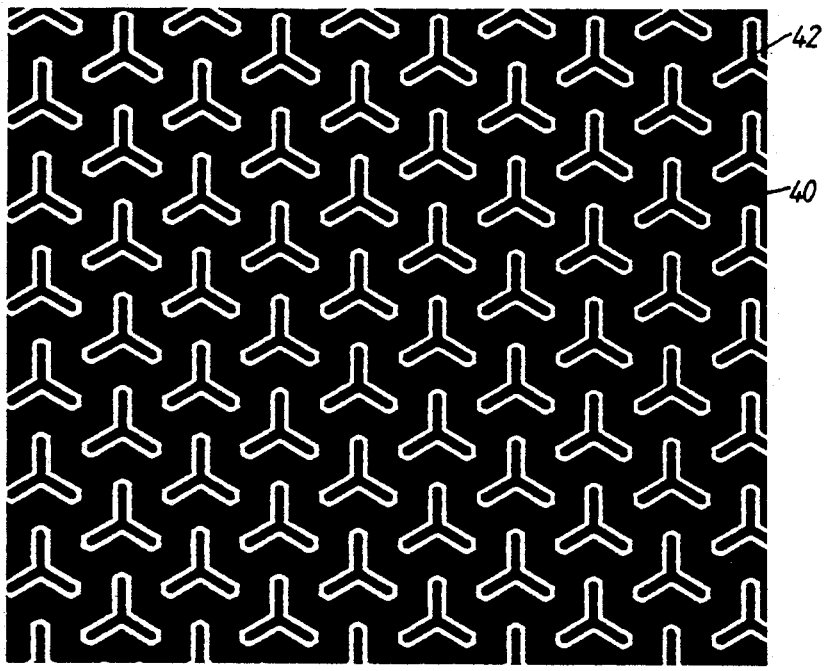
FIG. 4 is a view of the preferred material employed in accordance with the invention for providing a reflective surface in the lamp of FIG. 1.

FIG. 4 shows a preferred form of material for reflector 8 of the lamp structure shown in FIG. 1, the material 40 comprising a metal such as aluminium (alternatively a conductive plastics such as carbon reinforced plastics with a light reflective surface such as glass spheres in resin could be used) the metallic sheet having a regular array of tripolar slots 42. It may be seen from FIG. 4 that the array has mirror symmetry about three axes disposed at 120° to one another and that the slots are arranged in columns, with adjacent columns having their slots displaced by one half the dimension of the slot.

Referring to FIGS. 9 and 10, there is shown a method of forming the tripolar slot structure of FIG. 4. A thermo plastics sheet 60 is provided having upstanding ribs 64, 66 thereon (FIG. 10) to provide the tripolar slot configuration. The sheet 60 has a metallic silver layer 68 deposited thereon, and the ribs are subsequently ground down as at 66 to remove the silver material and provide a slot. Interconnecting regions 70 may be provided joining the vertices of the region within the slots to the main silvered area. The slot regions are painted with a non conductive paint which will reflect light.

Figure 5:
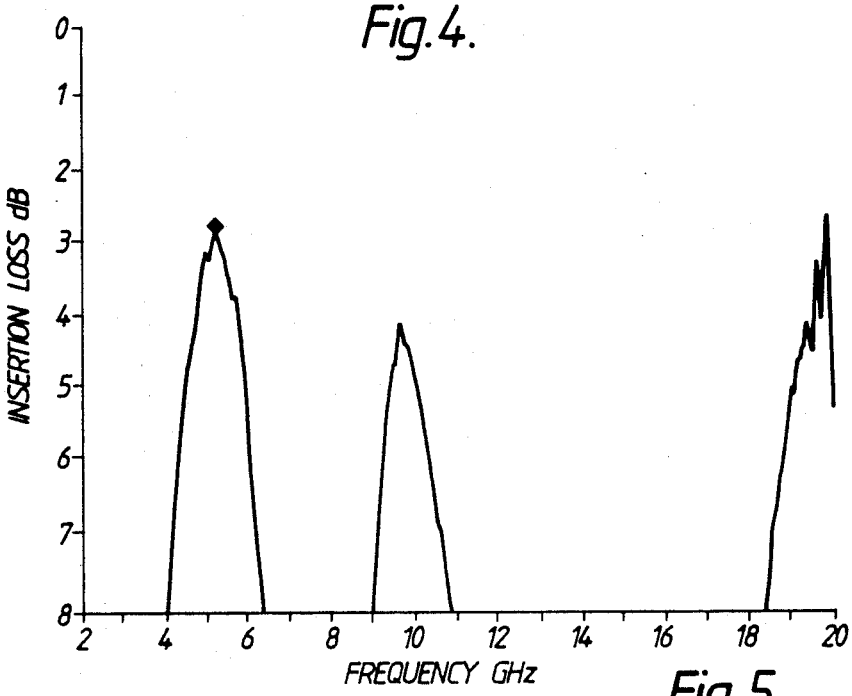
FIG. 5 is a graph showing the transmission properties of the surface.

FIG. 5 shows the transmission characteristics of the reflector 8 of FIG. 4 in the gigahertz region. It may be seen that the reflector has a fundamental pass band at about 5 gigahertz with further pass bands harmonically related to the fundamental band at 10 and 20 gigahertz. The use of a labyrinth pattern for the slots makes the position of the pass band virtually independent of angle of incidence. The percentage area available for optical reflection is over 75% of the total surface area of the reflector and hence the reflectivity for light wavelengths is only slightly degraded.

Figure 6:
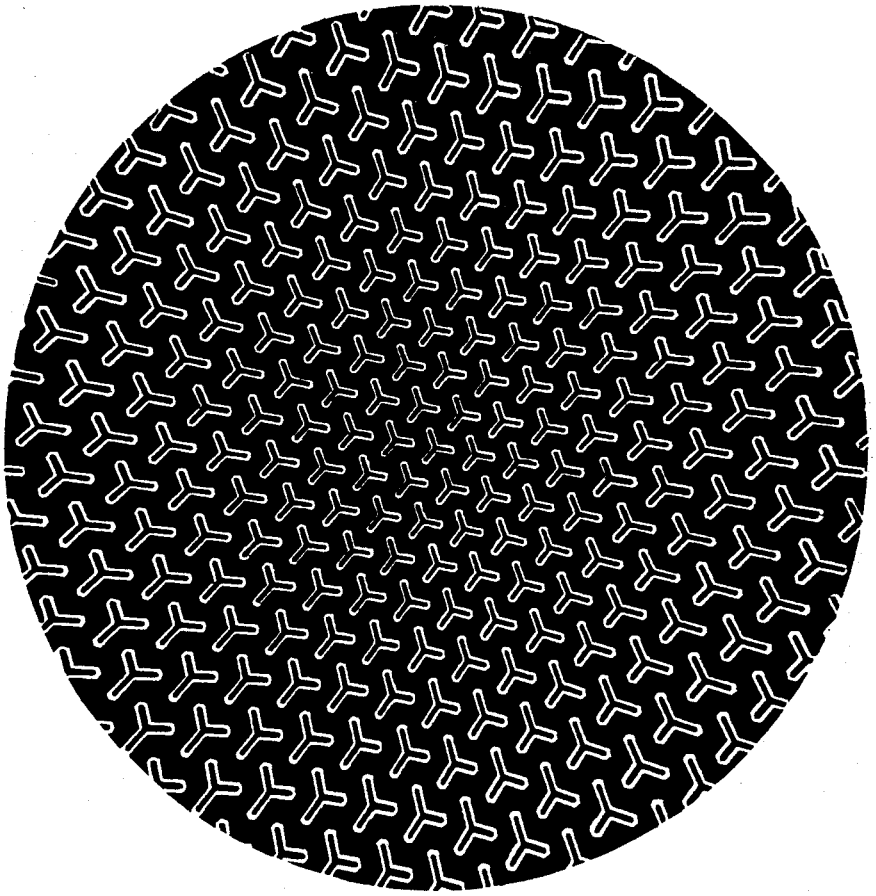
FIG. 6 is a view of a modified form of the reflector material which is adapted for projection onto a parabolic surface.
Figure 7A:
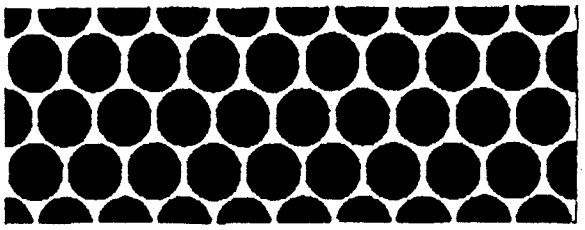
Figure 7B:
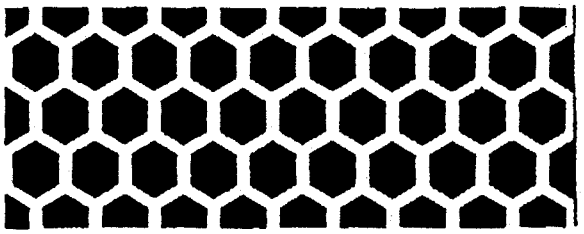
Figure 7C:
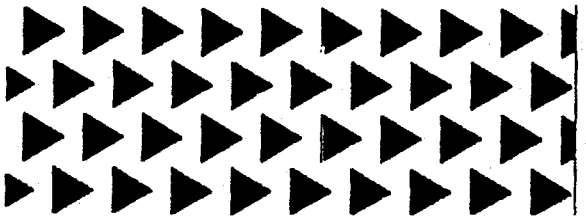
Figure 7D:
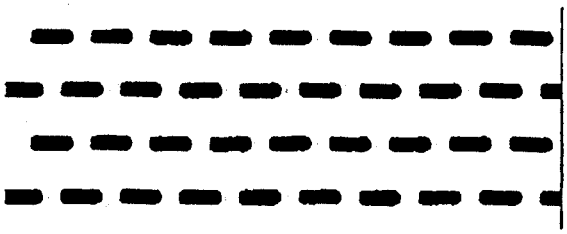
Figure 7E:
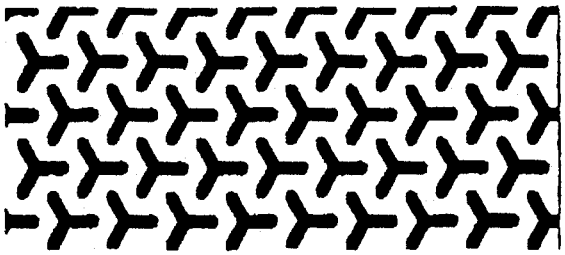
Figure 7F:
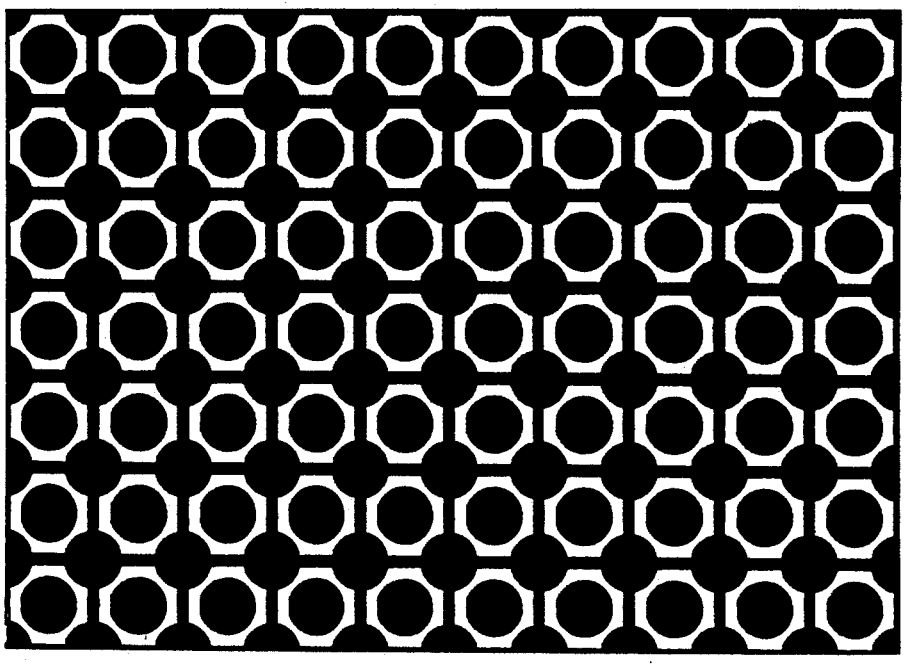

The arrangement shown in FIG. 4 is most suitable for a flat surface; a particularly preferred arrangement is shown in FIG. 6 wherein the arrangement of FIG. 3 is projected onto a parabolic surface so that although the arrangement shown is deformed as compared with the arrangement of FIG. 3, nevertheless once the reflector structure of FIG. 6 is positioned on a parabolic reflector surface, incident radiation will "see" the arrangement of FIG. 4. The dimensions of the array of FIG. 6 may be simply calculated by means of a computer from the arrangement of FIG. 4 using the basic equation as follows.

Projected distance from vertex =

$$\frac{R}{2}\sqrt{1+\frac{R^2}{L^2}}+\frac{L}{2}\ln\tan\left(\frac{\pi}{4}+\tfrac{1}{2}\tan^{-1}\frac{R}{L}\right)$$

where

R = distance from centre on the plane pattern and

L = semi latus rectum of the parabolic reflector

The advantage of using the basic configuration of tripolar slots is that the properties of the reflector remain independent of the polarisation state of the incident radiation. Other slot arrangements can give a similar property, for example a circular annular slot or slots arranged in the form of a triangle.

FIGS. *7e* to *7f* show other forms of slots which have been employed and give satisfactory results.

As an alternative arrangement shown in FIG. 8 an array of circular metallic discs 50 and longitudinal wires 52 arranged in a lattice structure are provided. It can be shown such arrangements have similar properties to a slotted surface.

In alternative arrangements, layers of the reflector materials of the type shown in FIGS. 4, 7 and 8 and particularly FIGS. *7a* and *7f* may be superposed upon one another, spaced by an appropriate distance from one another. This has the effect of modifying the pass band, for example by widening the pass band. There is a problem of increased insertion loss, but this can be reduced by appropriate positioning of the superposed layers.

Thus in a preferred structure of airfield approach landing lamp, as much as the lamp as possible is made of low dielectric constant plastic material, which is relatively transparent to the radar beam, but the reflector of the lamp is coated with the resonant slotted metal surface according to the invention. The reflector with slots is approximately 80% metal, and if the slotted parts are backed with a white reflecting surface, there is little reduction in light reflection when compared with a reflector made of 100% metal.

Thus important features of the invention are as follows:

1. A light reflector in the form of a parabolic plastic dish, with the front surface coated with a metal film which has some of its area removed in a regular way so as to form an array of slots, annuli, which has still sufficient metal surface to provide a very good reflector of light but, at the same time, will transmit a specific radar frequency.

2. Any other array of metal discs, wires, shapes, which will reflect light adequately but will also pass one or more frequencies in the radar bands. This might apply to low interference lights in microwave anechoic chambers.

3. The use of metallic structures in other situations where a particular radar frequency or band of frequencies needs to pass unhindered (not radomes). For example, as a supporting structure for the landing light or in any other case where there is an obstruction in the path of a radar signal which is affecting the correct working of the radar system, e.g. support pylon in an anechoic chamber.

4. The use of arrays of metal discs, wires, shapes or the corresponding apertures in a conducting sheet, in single or multiple layers, spaced as required, in situations (including radomes) where a particular frequency or band of frequencies needs to pass unhindered, but frequencies outside these bands are to be rejected.

What is claimed:

1. A structure for reflecting visible light or near visible light, wherein the structure is formed of a low dielectric constant material having an external light reflector surface comprising an electrically conductive layer of material which has an array of slots therein so as to be substantially transparent to microwave radiation of a predetermined wavelength which will impinge upon the structure during use, whilst being reflective to light emitted from a light source associated with said structure.

2. A structure as claimed in claim 1 or wherein the light reflector surface is formed of a metal layer deposited on a plastics surface.

3. A structure as claimed in claim 1 wherein the low dielectric constant material comprises a plastics surface which has ribs formed therein in the pattern of said array of slots, and said slots are formed by grinding down the ribs subsequent to forming said electrically conductive layer thereon.

4. A structure as claimed in claim 1 wherein said array of slots comprises a regular array of elemental areas.

5. A structure as claimed in claim 5 wherein each area includes a tripolar slot configuration.

6. A structure as claimed in claim 1 wherein said array of slots is such that, when the reflector surface is formed on a non-planar, for example parabolic surface, the surface provides to incoming radiation, a regular array of elemental areas, each area including a tripolar slot configuration.

7. A structure as claimed in claim 1 including a plurality of said electrically conductive layers stacked one upon the other and separated by a predetermined distance in order to widen the pass band for incident microwave radiation.

8. A structure as claimed in claim 1 wherein the array of slots comprises a regular array of elemental areas, each area including a slotted configuration defining a tripolar slot.

9. A structure as claimed in claim 1 wherein the array of slots comprises a regular array of elemental areas, each area including a slotted configuration defining a tripolar slot projected onto a parabolic surface.

10. A structure as claimed in claim 1 wherein the array of slots comprises a regular array of elemental areas, each area including a slotted configuration defining a disc shape.

11. A structure as claimed in claim 1 wherein the array of slots comprises a regular array of elemental areas, each area including a slotted configuration defining a hexagon shape.

12. A structure as claimed in claim 1 wherein the array of slots comprises a regular array of elemental areas, each area including a slotted configuration defining a triangle shape.

13. A structure as claimed in claim 1 wherein the array of slots comprises a regular array of elemental areas, each area including a slotted configuration defining a bar shape.

14. A structure as claimed in claim 1 wherein the array of slots comprises a regular array of elemental areas, each area including a slotted configuration defining a tripolar bow shape.

15. A structure as claimed in claim 1 wherein the array of slots comprises a regular array of elemental areas, each area including a slotted configuration defining a disc shape joined to its nearest neighbours by conductive line portions.

16. A structure as claimed in claim 1 wherein the array of slots comprises a regular array of elemental areas, each area including a slotted configuration defining a disc shape disclosed within a rectangular frame defined by conductive line portions.

17. A light as claimed in claim 1 mounted on a mast structure comprising a rotatable tripod.

18. An airfield approach landing light and supporting structure therefor being formed of low dielectric constant plastics material and having an external light reflector surface comprising a layer of electrically conductive material which has an array of slots therein such as to be substantially transparent to microwave radiation of a predetermined frequency whilst being reflective to light emitted from a light source associated with said structure.

19. A light as claimed in claim 18 wherein a filament of the light source and/or bulb electric contacts are arranged perpendicular to a direction of incident microwave radiation.

20. A light as claimed in claim 18 wherein a holder for said light bulb is formed of a ceramics material transparent to microwave radiation.

21. A light as claimed in claim 18 including a transparent light lens formed of a plastics material having an insertion loss of less than 1db for microwave radiation.

22. A light as claimed in claim 18 wherein the housing for the light is formed of non-conductive dielectric plastics material.

* * * * *